United States Patent [19]

Carlson et al.

[11] Patent Number: 4,521,755

[45] Date of Patent: Jun. 4, 1985

[54] SYMMETRICAL LOW-LOSS SUSPENDED SUBSTRATE STRIPLINE

[75] Inventors: Eric R. Carlson, Fair Haven; Martin V. Schneider, Holmdel, both of N.J.

[73] Assignee: AT&T Bell Laboratories, Murray Hill, N.J.

[21] Appl. No.: 388,031

[22] Filed: Jun. 14, 1982

[51] Int. Cl.[3] ..... H01P 3/06; H01P 3/08

[52] U.S. Cl. ..... 333/244; 333/238; 333/246; 333/204

[58] Field of Search ..... 333/238, 246, 204, 222, 333/128, 248, 250, 251, 247, 239, 242, 81 A, 244, 243

[56] References Cited

U.S. PATENT DOCUMENTS

| | | | |
|---|---|---|---|
| 2,774,046 | 12/1956 | Arditi et al. | 333/81 A |
| 2,926,317 | 2/1960 | Blitz | 333/238 |
| 3,009,008 | 11/1961 | Lapsley et al. | 333/243 X |
| 3,025,480 | 3/1962 | Guanella et al. | 333/243 X |
| 3,050,702 | 8/1962 | Kibler . | |
| 3,093,805 | 6/1963 | Osifchin et al. | 333/238 X |
| 3,321,720 | 5/1967 | Shimada . | |
| 3,487,340 | 12/1969 | Curtis et al. | 333/248 X |
| 3,512,091 | 5/1970 | Blixt . | |
| 3,524,190 | 8/1970 | Killon et al. | 333/243 X |
| 3,863,181 | 1/1975 | Glance et al. | 333/246 X |
| 4,233,579 | 11/1980 | Carlson et al. | 333/238 X |

OTHER PUBLICATIONS

Brenner, Helmut, "Use a Computer to Design Suspended Substrate IC's", *Microwaves*, Sep. 1968, pp. 38–43.

*Primary Examiner*—Eugene R. Laroche
*Assistant Examiner*—Benny T. Lee
*Attorney, Agent, or Firm*—John Francis Moran

[57] ABSTRACT

A stripline features high symmetry and promotes uniform current densities to lower losses. The channel (11) of the outer conductor of the stripline has a generally circular cross-section. Opposing lateral grooves (13,14) securely positions a substrate (16) which includes a center conductor. The center conductor features dual metalized strips (17,18) connected together by spaced through-plated holes (19). The stripline is readily formed in a single block of metal and hence eliminates the losses associated with the joint of conventional split-block striplines.

5 Claims, 14 Drawing Figures

SYMMETRICAL LOW-LOSS SUSPENDED SUBSTRATE STRIPLINE

This invention relates to electrical transmission lines and, more particularly, to transmission lines suitable for high frequency applications.

Strip transmission lines, or striplines, are being used extensively for high frequency applications because of their obvious performance advantages. The conventional geometry for striplines utilizes rectangular cross-sectional passages, called channels, usually formed between two sections or metal blocks which are joined together to enclose the channel and serve as the outer conductor. The inner conductor is a metalized strip on a dielectric substrate which occupies rectangular ridges formed in one of the two blocks so that the substrate is supported in the central region of the channel.

The chief disadvantage of striplines is their rather high cost of fabrication. Expensive machining by milling is required to form the channels and ridges. Such fabrication is a relatively slow process and requires high precision to define the small dimensions for high frequency and short wavelength structures. Furthermore, precisely located alignment pins and corresponding holes are required for accurately joining the blocks to obtain requisite dimensional control for the rectangular channel geometry. Even the surfaces at the junction of the blocks should be planar and highly polished to minimize losses.

Accordingly, it would be highly desirable to have a structure for striplines which offers superior performance advantages but is easy to fabricate and relatively inexpensive. For example, due to the small dimensions associated with extremely high frequencies air line characteristics are desirable because the RF wavelengths are not shortened by the dielectric constant of dielectric material. Also, dielectric losses are minimized in air lines. Symmetry is also desirable for promoting uniform density in the field distributions which serves to reduce transmission and circuit losses.

SUMMARY OF THE INVENTION

A new structure for striplines is presented suitable for easy and low cost fabrication wherein the outer conductor is drilled and reamed in a single conductive block to form a cylindrical channel which has a circular lateral cross-section. The surface wall of the channel may be easily highly finished by pressing a polished steel ball through the hole after reaming. A broaching tool formed of hardened tool steel may be utilized to form lateral notches by reaming which extend along the length of the cylindrical channel. The notches position and support a dielectric substrate which includes a metalized strip serving as a center conductor for the stripline.

An aspect of the invention is the high symmetry provided by a channel of substantially circular cross-section and a center conductor featuring dual metallization on opposed surfaces of the supporting dielectric substrate. Various modifications to the center conductor for lowering conductive losses include corrugated fingers extending laterally along its edges and controlling the thickness of the center conductor metallization and thickness of the dielectric material. Through-plated holes are strategically spaced in the center conductor to promote electromagnetic propagation of a desired mode while suppressing formation of undesired modes.

BRIEF DESCRIPTION OF THE DRAWINGS

In addition to the foregoing aspects and features of the present invention, others will be readily apparent from the following detailed description, taken in combination with the accompanying drawing.

DETAILED DESCRIPTION

Figure 1:
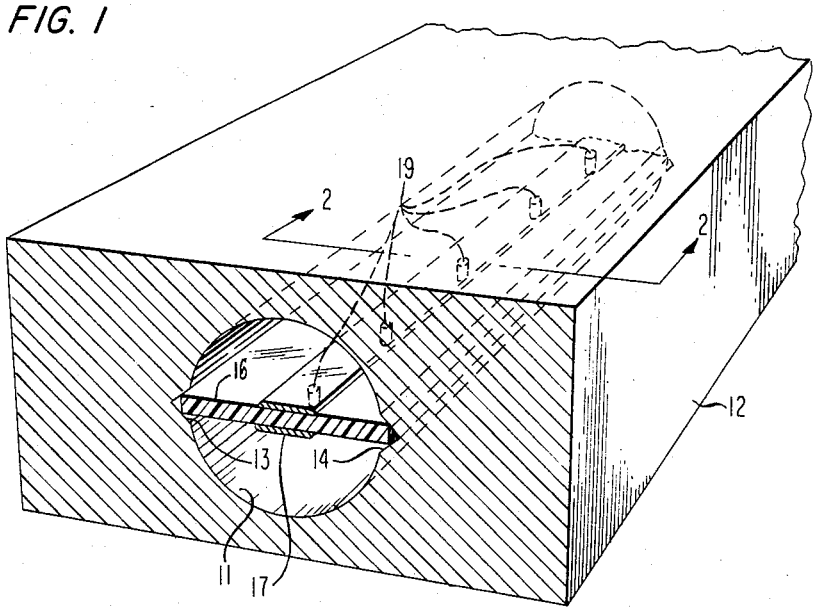
FIG. 1 is a perspective view of the inventive stripline geometry.

In FIG. 1, there is shown an arrangement embodying the principles of the present invention wherein stripline channel 11 is advantageously produced in outer conductor 12. Typically outer conductor 12 is a metal block of fairly high conductivity and is readily machinable, such as brass, for example. In conductor 12, channel 11 is conveniently formed by drilling and reaming. Accordingly, channel 11 has a circular cross-section which extends to form a cylindrical passage in conductor 12. A polished finish on the wall of channel 11 is readily obtained by pressing a tight fitting polished steel ball through the channel. Of course, other ways of providing a smooth surface finish may be utilized. Channel 11 includes two laterally opposing grooves 13 and 14 which typically run longitudinally with the channel. Grooves 13 and 14 are v-shaped and designed to accommodate the lateral sides of substrate 16 which is positioned in the central region of channel 11.

On substrate 16, a center conductor strip employs dual metalization on the lower and upper surfaces of the substrate. Lower stripe 17 and upper strip 18 of the center conductor are connected together by a series of through plated holes 19. Typically, holes 19 are spaced about 1/10 of a wavelength apart. This serves to suppress the formation of extraneous modes of electromagnetic wave propagation in the stripline and provides a lower loss for the preferred TEM mode of transmission.

Figure 2:
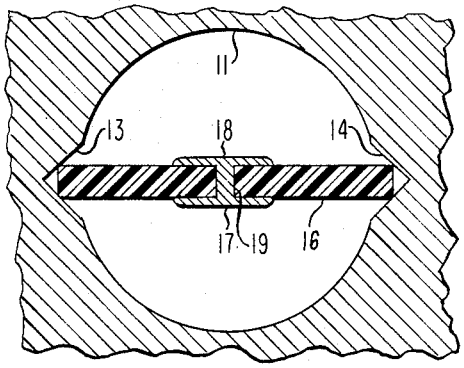
FIG. 2 is a cross-sectional view of the channel about access 2—2.

FIG. 2 is a cross-sectional view of the channel of FIG. 1 in accordance with cross-sectional axis 2—2 shown therein. In FIG. 2 like reference numerals are utilized to designate like components of the structure in accordance with FIG. 1. FIG. 2 more clearly illustrates the position of substrate 16 which is secured by grooves 13 and 14 in channel 11. Also, FIG. 2 illustrates that lower conductor 17 and upper conductor 18 are electrically connected together by through-plated hole 19. Relevant processing technology for through-plated holes, or feedthrough conductors, in substrate material is disclosed in J. Appl. Phys. 52(8) August 81 by T. R. Anthony, entitled "Forming Electrical Interconnections Through Semiconductor Wafers" at pp. 5340–5349.

Figure 3:
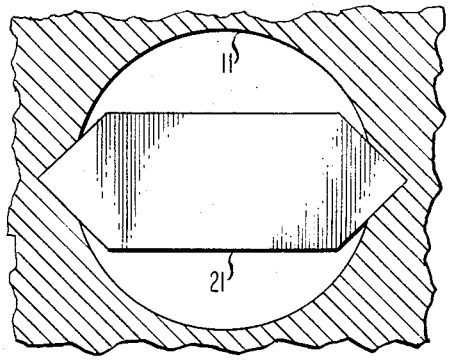
FIG. 3 illustrates the cross-section of the broaching tool for forming the laterally opposing grooves in the stripline channel.

FIG. 3 illustrates a cross-sectional view of broaching tool 21 which forms grooves 13 and 14 by reaming channel 11. Accordingly, grooves 13 and 14 are appropriately sized for the thickness of dielectric substrate 16. Although FIG. 3 illustrates the cross-section of the cutting portion of broaching tool 21 such a tool may include a guiding front cylindrical section whose diameter conforms to that of channel 11.

As will become more clearly understood in the following description, the inventive transmission line is essentially an air line wherein the major portion of the field energy is concentrated in the upper and lower air gaps about substrate 16. Only a small portion of the total field energy formed by the propagating electromagnetic wave through the transmission line occurs within the dielectric material of substrate 16. If the diameter of channel 12 is $2a$ in dimension, the approximate cutoff frequency without regard to the notches in dielectric loading is $$\frac{\lambda_c}{a} = 3.414$$

for the $TE_{11}$ circular waveguide mode, for example, if the radius is $a=0.100$ inches or approximately 0.25 cm then $\lambda_c=0.85$ cm and the frequency $f_c=35.2$ GHz. Thus to insure fundamental mode TEM propagation for these dimensions, the frequency of operation should be below frequency $f_c$.

The electrical field loss of this geometrical structure for striplines is relatively low. First since the major portion of the electric field is in the air gap above or below the center conductor, the electric field intensity in the dielectric is so low as to be almost negligible. Accordingly, the effective loss tangent for tan $\delta$ is given by $(\tan\delta)_{eff}=(\epsilon_r/\epsilon_{eff}).(\partial\epsilon_{eff}/\partial\epsilon_r)\tan\delta$, where $\partial\epsilon_{eff}/\partial\epsilon_r$ is the partial derivative of the effective dielectric constant with respect to the relative dielectric of the substrate material. In this case, the partial derivative is much less than unity so that the $(\tan\delta)_{eff}\approx 0$.

Accordingly, the effective dielectric constant $\epsilon_{eff}\approx 1$ where $$\lambda_g = \frac{\lambda_0}{\sqrt{\epsilon_{eff}}} \approx \lambda_0.$$

Accordingly, the wavelength in the stripline is approximately equal to the wavelength in a vacuum. Thus, the dimensions of circuit components, such as, for example, quarter wave stubs and half wave length resonators, are larger than for conventional microstrip transmission lines with $\delta_g \approx \delta_0/\sqrt{\epsilon_r}$. As a result all geometrical dimensions may be increased by the square root of $\epsilon_r$ over the dimensions of conventional microstrip circuits. The increased size has the effect of lowering current densities to reduce resistance losses in the metallic conductors while increasing the Q value. Also the new structure has the ability to suppress waveguide modes at harmonics of the primary operating frequency due to the high symmetry of the structure.

Figure 4:
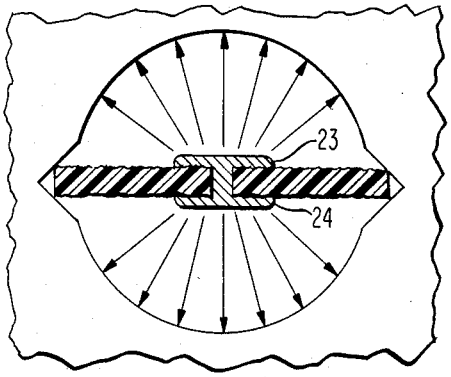
FIG. 4 is a cross-sectional view illustrating the rough surface which is typical of commonly used dielectric material for a substrate.

FIG. 4 illustrates the typical rough surface of a dielectric including glass fibers for reinforcement. A suitable dielectric material for substrates is generally known under the trademark of RT/DUROID 6010 glass microfiber PTFE material manufactured by Rogers Corp. located in Chandler, Ariz. In such a case, the position of the field lines demonstrate the location of the electomagnetic field as primarily existing around the outer region of the center conductor. As a result, most of the current flows near exterior surfaces 23 and 24 of the center conductor and tends to reduce resistive losses. Even if the substrate surface is smooth, the metal used to provide bonding to the dielectric material is usually of higher resistivity and then typically covered with lower resistivity metal, such as copper or gold. So here again, it is advantageous to have the electrical current flow near the exterior surface of the center conductor.

Figure 5:
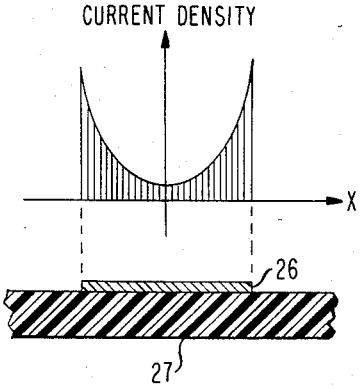
FIG. 5 (PRIOR ART)
FIG. 5 depicts the uneven current density typical of prior art striplines.
Figure 6:
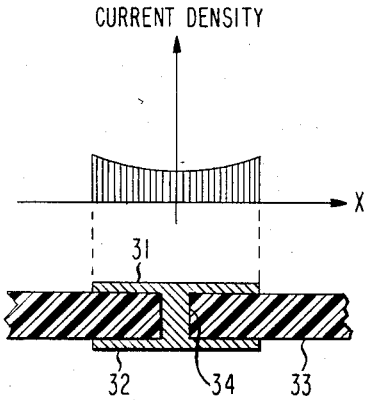
FIG. 6 illustrates the fairly uniform current density characteristic of the inventive stripline structure.

FIGS. 5 and 6 illustrate current density distributions across the widths of the center conductors, respectively, the prior art stripline and the present stripline. As shown in FIG. 5, the current density in center conductor 26 on dielectric conductor 27 is nonuniform. This is a result of the fact that at the edges of center conductor 26 the field intensity is high and thus more current flows near the edges. In FIG. 6, the current density is more uniform and flows through sections 31 and 32 of the dual metalized center conductor on substrate 33. Through-plate hole 34 connects stripes 31 and 32 together to keep them at the same potential. Since the field distribution associated with strips 31 and 32 is more uniform (shown in FIG. 4), the current density also tends to be more uniform which desirably lowers the effective resistive loss of the center conductor.

Figure 7:
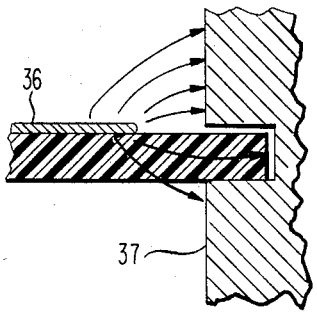
FIG. 7 (PRIOR ART)
FIG. 7 illustrates the high field density and small edge capacitance produced in conventional stripline structures.
Figure 8:
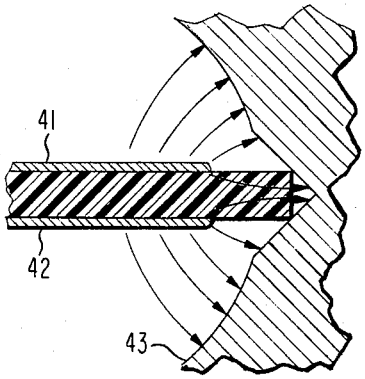
FIG. 8 illustrates an electric field distributed over a much greater conductor area in the inventive structure for providing increased capacity between the edge of the center conductor and the outer conductor over that of FIG. 7.

FIGS. 7 and 8 illustrate the electric fields which promote capacitance between the center conductor and ground respectively in the prior art and in the present stripline. In FIG. 7, the edge of center conductor 36 presents a rather small area in relationship to ground plane which is outer conductor 37. Thus the edge capacitance changes very rapidly as a function of the distance between the edge of the center conductor and the outer conductor which makes circuit components such as filters which utilize capacitive elements difficult to realize in conventional stripline structures. In FIG. 8 the center conductor comprises dual metalization present in the form of stripes 41 and 42. As a result a much larger area is presented for field formation with outer conductor 43. Accordingly, the edge capacitance can be much better controlled, and requires less critical tolerance for the present structure compared to the conventional structure. Furthermore, since the high electric field is distributed over a much larger conductor area and the boundary of outer conductor 43 is curved toward stripes 41 and 42, the physical geometry serves to greatly increase the capacitance per unit area.

Figure 9:
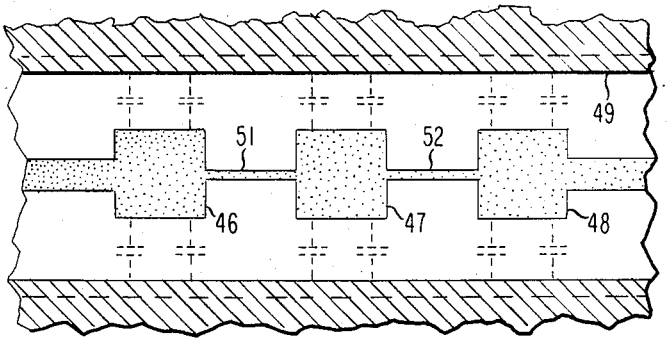
FIG. 9 illustrates a typical center conductor designed wherein the increased edge capacitance may be utilized to form microwave filters.

FIG. 9 illustrates a typical filter design which utilizes alternate capacitance and inductance sections in the center conductor of the present stripline structure. Capacitance sections 46-48 promote the formation of electric fields with outer conductor 49 in accordance with FIG. 8. The resulting capacitors are symbolically illustrated in the figure. Between the capacitance sections, inductance is formed by the reduced size of sections 51 and 52 of the center conductor.

Figure 10:
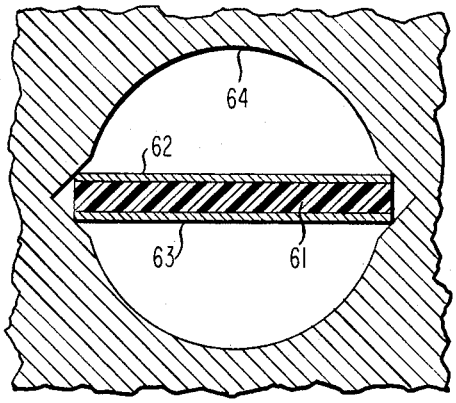
FIG. 10 is another cross-sectional view wherein the center conductor conveniently establishes good electrical contact with the outer conductor.

FIG. 10 demonstrates the convenient manner of connecting center conductor 62,63 to outer conductor 64. Briefly, the center conductor 62,63 is extended to the edge of dielectric 61. Good electrical contact is readily established between stripes 62 and 63 and outer conductor 64.

Figure 11:
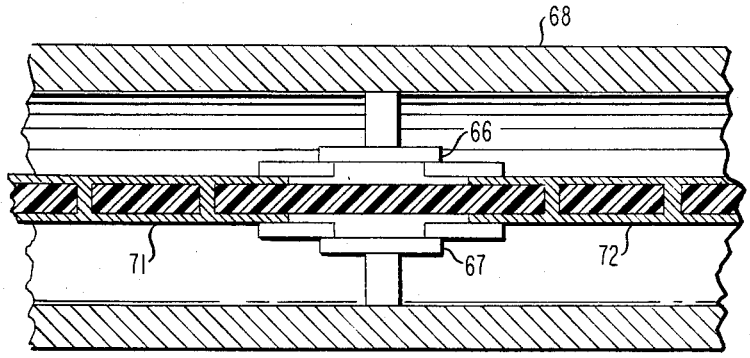
FIG. 11 is a cross-sectional view of two three terminal devices mounted in the new stripline channel.

FIG. 11 is a lateral cross-sectional view of the inventive stripline taken at the location of devices. Two electrical devices 66 and 67 extend from the center conductor to outer conductor 68. As can be observed from FIG. 11, the center conductor is divided into two sections 71 and 72 so that each of devices 66 and 67 may be three terminal devices with the terminals being connected to outer conductor 68 and sections 71 and 72 of the center conductor. Although two devices are illustrated in FIG. 11, a single device may be utilized to advantage if desired. However, the use of two devices beneficially preserves the symmetry of the stripline structure so that each device participates equally.

Figure 12:
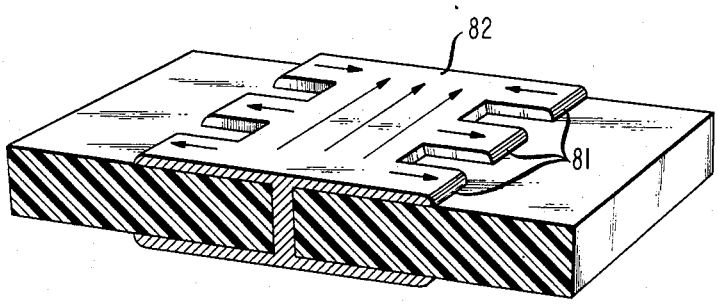
FIG. 12 depicts a center conductor whose edges are corrugated for lowering losses.

FIG. 12 illustrates a technique for reducing the intensity of edge currents in a center conductor of a symmetrical stripline. Previously, FIG. 6 demonstrated a more uniform current density distribution in a center conductor is achieved in the new symmetrical structure as compared to conventional current density distributions for prior art structures shown in FIG. 5. But even in FIG. 6 edge currents are greater than those throughout the conductor so that corrugated edges, or fingers 81, of FIG. 12 suppress the intensity of the edge currents. Arrows in FIG. 12 illustrate where the main current flow occurs in center conductor 82 while longitudinal edge currents are suppressed with only transverse charging and discharging currents associated with the capacitive effect of fingers 81. Of course, the corrugations may be designed to have a saw tooth outline, or another outline, and still achieve the same desirable effects as those with the rectangular shaped fingers.

Another benefit of the corrugated center conductors is its effect on the overall characteristic impedance of the stripline. It should be understood that the corrugations may be cut into the edge of an existing center conductor or may be extensions from the edge of an existing conductor. The longitudinal edge currents are suppressed in either case. The impedance Z of an uncorrugated structure such as shown in FIG. 1 is calculated by $$Z = \sqrt{\frac{L}{C}}$$

where L is the inductance of the line per unit length and C is the capacitance of the line per unit length. When fingers are added, the impedance $Z_c$ is determined by $$Z_c = \sqrt{\frac{L}{C + \Delta C}}$$

where $\Delta C$ is the capacitance of the corrugated fingers per unit length along the Z-axis. Accordingly, the impedance $Z_c$ is lower than Z which is desirable for amplifier circuits utilizing FET power devices. Such amplifiers are used in satellite and terrestrial radio circuits where striplines exhibiting both low-loss and loss-impedance will enhance performance.

Another effect which increases losses in conductors at high frequencies is the skin effect which increases the intensity concentration of currents near the conductor's surface so that the bulk of the conductor passes very little current thereby increasing resistive losses. In general, the current in a thick conductor flows in a band starting at the surface and ending below the surface to a depth related to the frequency. This depth or thickness is given by $$\sigma = \sqrt{\frac{\rho}{\pi \mu_0 \mu_r} f}$$

where f is the frequency in Hertz, $\mu_0 = 4\pi \times 10^{-7}$ Henry/meter, $\rho$ is the resistivity of the metal in Ohm-meter ($\Omega$m) and $\mu_r$ is the relative permittivity of the metal.

For example, at the frequency of 10 GHz in a copper structure having a resistivity of $\rho = 1.72 \times 10^{-8}$ $\Omega$m, the skin depth $\delta$ is 0.66 micrometers.

Figure 13:
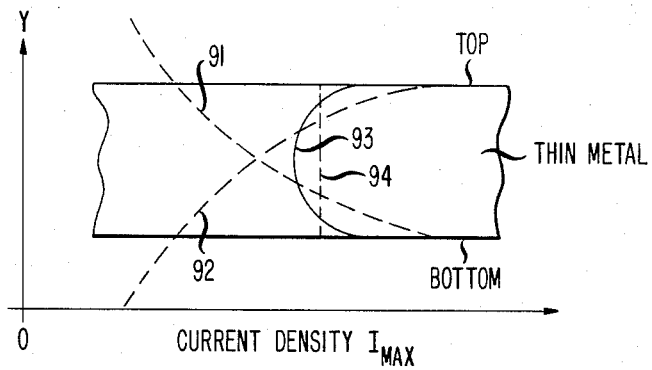
FIG. 13 illustrates the distribution of relative current densities as a function of conductor thickness.

FIG. 13 depicts current distributions for conductors of thickness corresponding from one to four skin depths. In FIG. 13 curve 91 shows the exponential decay of the current for a thick film, if one assumes that the current at the top surface is a minimum and the curve at the bottom is a maximum. Curve 92 illustrates an exponential decay inverse to that of curve 91 with the maximum current corresponding to the top surface. Curve 93 illustrates a desirable current density profile for a thin film in the range of one to four skin depths. Due to the interaction and coupling of the decaying fields from the top and bottom surface and the proximity of these surfaces to each other, the resulting profile is not an exponential function and the maximum current at the surface is smaller than that present in curves 91 and 92. Curve 94 represents the current density as being uniform for an extremely thin film. In this case, the film has the properties of a resistive thin sheet.

Figure 14:
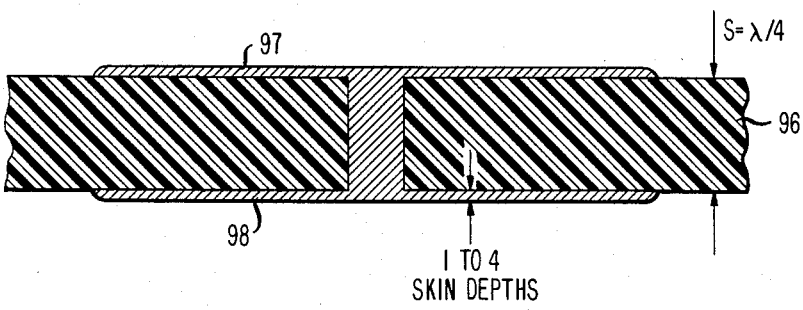
FIG. 14 is a cross-section of a center conductor including the supporting dielectric serving to illustrate desirable dimensional relationships for lowering losses.

FIG. 14 illustrates a cross-section of the complete center conductor wherein dimensional relationships are observed to minimize transmission loss. In FIG. 14, the thickness of dielectric 96 corresponds to a quarter of the wavelength. Here it is important that the surfaces of substrate 96 be smooth. Typical suitable materials are fused quartz, alumina, sapphire or glass. The thickness is $$S = \frac{\lambda_0}{4\sqrt{\epsilon_r}}$$

where $\lambda_0$ is the vacuum wavelength at the frequency of operation and $\epsilon_r$ is the relative dielectric constant for the substrate material. Upper portion 97 and lower portion 98 of the filter conductor are deposited thin metal films with the thickness of one to four skin depths with a number of through-plated holes 99 disposed along the Z axis. When the dimensional relationships are observed in FIG. 14, dielectric substrate 96 acts as a quarterwave transformer which means that the impedance seen at either the bottom of the top film looking towards the bottom film is an open circuit. This will maximize the current at the bottom of the top film and thus give a relatively uniform current distribution in the top film serving to decrease attenuation.

Although the illustrative embodiment of the invention is disclosed in the context of a transmission line, it should be understood that striplines are typically utilized in numerous microwave circuits such as mixers, oscillators, frequency multipliers, etc. Accordingly, those skilled in the art may use the inventive principles to advantage in such circuits. Also the low-loss features of the invention make it desirable for any application where loss considerations are a serious concern. It is understood that those skilled in the art may make numerous and varied other modifications without departing from the scope of the invention.

What is claimed is:

1. A two-conductor, two-terminal transmission line for radio frequency energy comprising:

a cylindrical channel outer conductor formed within a single, integral mechanically rigid continuous material, at least the surface of the cylindrical channel having a continuous metallic conductive material, a planar line inner conductor having a rectangular cross-sectional shape positioned substantially centrally within the cylindrical channel and extending substantially coextensively with the length of the transmission line to form a rigid, inflexible transmission line having precise dimensional control and symmetry of the geometry within the cylindrical channel wherein field energy is evenly distributed in the air region above and below the planar line inner conductor in the cylindrical channel to provide substantially uniform current densities thereby reducing transmission losses in the transmission line, and transmission line further comprises laterally opposing grooves having a triangular cross-section extending longitudinally in the cylindrical channel and a rigid dielectric member serving as a substrate for supporting and positioning said inner conductor wherein said inner conductor comprises two strips mounted on opposing surfaces of said dielectric member and the thickness of the inner conductor is between one to four skin depths at the frequency of operation.

2. A two-conductor, two-terminal transmission line for radio frequency energy comprising:

a cylindrical channel outer conductor formed within a single, integral mechanically rigid continuous material, at least the surface of the cylindrical channel having a continuous metallic conductive material, a planar line inner conductor having a rectangular cross-sectional shape positioned substantially centrally within the cylindrical channel and extending substantially coextensively with the length of the transmission line to form a rigid, inflexible transmission line having precise dimensional control and symmetry of the geometry within the cylindrical channel wherein field energy is evenly distributed in the air region above and below the planar line inner conductor in the cylindrical channel to provide substantially uniform current densities thereby reducing transmission losses in the transmission line, and the transmission line further comprises laterally opposing grooves having a triangular cross-section and extending longitudinally in said channel, and a rigid dielectric member serving as a substrate for supporting and positioning said inner conductor wherein said inner conductor comprises two strips mounted on opposing surfaces of said dielectric member, and the thickness of said dielectric member corresponds one-quarter of a wavelength in the dielectric material at the frequency of operation.

3. A two-conductor, two-terminal transmission line for radio frequency energy comprising:

a cylindrical channel outer conductor formed within a single, integral mechanically rigid continuous material, at least the surface of the cylindrical channel having a continuous metallic conductive material, a planar line inner conductor having a rectangular cross-sectional shape positioned substantially centrally within the cylindrical channel and extending substantially coextensively with the length of the transmission line to form a rigid, inflexible transmission line having precise dimensional control and symmetry of the geometry within the cylindrical channel wherein field energy is evenly distributed in the air region above and below the planar line inner conductor in the cylindrical channel to provide substantially uniform current densities thereby reducing transmission losses in the transmission line, and the transmission line further comprises laterally opposing grooves having a triangular cross-section and extending longitudinally in said channel, and a rigid dielectric member serving as a substrate for supporting and positioning said inner conductor and said inner conductor comprises two strips mounted on opposing surfaces of said dielectric member wherein said inner conductor includes through-plated holes longitudinally spaced along said center conductor on the order of one-tenth of a wavelength apart at the frequency of the radio frequency energy.

4. A two-conductor, two-terminal transmission line for radio frequency energy comprising:

a cylindrical channel outer conductor formed within a single, integral mechanically rigid continuous material, at least the surface of the cylindrical channel having a continuous metallic conductive material;

a planar line inner conductor having a rectangular cross-sectional shape positioned substantially centrally within the cylindrical channel, the planar line inner conductor including corrugations in its edges to produce a more uniform current distribution for lowering conductive losses in the planar line inner conductor, the planar line inner conductor extending substantially coextensively with the length of the transmission line to form a rigid, inflexible transmission line having precise dimensional control and symmetry of the geometry within the cylindrical channel wherein field energy is evenly distributed in the air region above and below the planar line inner conductor in the cylindrical channel to provide substantially uniform current densities thereby reducing transmission losses in the transmission line the transmission line further comprises laterally opposing grooves having a triangular cross-section and extending longitudinally in said channel, and a rigid dielectric member serving as a substrate for supporting and positioning said planar line inner conductor wherein said planar line inner conductor comprises two strips mounted on opposing surfaces of said dielectric member.

5. A transmission line according to claim 4 wherein the corrugations of the inner line planar conductor have fingers with a capacitance per unit length of $\Delta C$ to produce a characteristic impedance of $$Z_c = \sqrt{\frac{L}{C + \Delta C}}$$

where L is the inductance of the transmission line per unit length and C is the capacitance of the transmission line per unit length.

* * * * *